US012195967B1

(12) United States Patent
Rauch et al.

(10) Patent No.: US 12,195,967 B1
(45) Date of Patent: Jan. 14, 2025

(54) LARGE CAPACITY GUTTER

(71) Applicant: Metal-Era, Inc., Waukesha, WI (US)

(72) Inventors: Aaron Rauch, Watertown, WI (US); Larry Wagner, Kewaskum, WI (US); Chris Parent, Mukwonago, WI (US)

(73) Assignee: METAL-ERA, INC., Waukesha, WI (US)

( * ) Notice: Subject to any disclaimer, the term of this patent is extended or adjusted under 35 U.S.C. 154(b) by 0 days.

(21) Appl. No.: 18/205,736

(22) Filed: Jun. 5, 2023

(51) Int. Cl.
*E04D 13/072* (2006.01)

(52) U.S. Cl.
CPC ..... *E04D 13/0725* (2013.01); *E04D 13/0722* (2013.01)

(58) Field of Classification Search
CPC ..... E04D 13/0725; E04D 13/072; E04D 13/0722
See application file for complete search history.

(56) References Cited

U.S. PATENT DOCUMENTS

| | | | | | |
|---|---|---|---|---|---|
| 5,570,860 | A * | 11/1996 | Schoenherr | E04D 13/0725 248/48.2 |
| 5,737,879 | A * | 4/1998 | Sweet | E04D 13/076 52/12 |
| 6,701,674 | B1 * | 3/2004 | Albracht | E04D 13/076 52/12 |
| 7,617,636 | B1 * | 11/2009 | Armstrong | E04D 13/064 52/63 |

FOREIGN PATENT DOCUMENTS

| | | | | |
|---|---|---|---|---|
| DE | 3722637 | A * | 1/1989 | E04D 13/064 |
| FR | 2203405 | A5 * | 5/1974 | |
| GB | 2371571 | A * | 7/2002 | |
| GB | 2397830 | A * | 8/2004 | |
| JP | H0578762 | U * | 10/1993 | |
| JP | H08105169 | A * | 4/1996 | |
| JP | 2001107521 | A * | 4/2001 | |
| JP | 2001140421 | A * | 5/2001 | |
| JP | 3410643 | B2 * | 5/2003 | |
| KR | 100540580 | B1 * | 1/2006 | |
| WO | WO-2005106159 | A1 * | 11/2005 | |
| WO | WO-2022250554 | A1 * | 12/2022 | |

* cited by examiner

*Primary Examiner* — Kimberly T Wood
(74) *Attorney, Agent, or Firm* — Donald J. Ersler

(57) ABSTRACT

A large capacity gutter includes a gutter member, a top hanger, a face support bracket, a lower mounting hanger, and a Z-bracket. A gutter cleat extends from the gutter member and is inserted into the lower mounting hanger. The top hanger preferably includes an upper building mount member, a lengthwise support member and a gutter support projection. The face support bracket preferably includes an L-building mount member, an L-lengthwise support member and an L-vertical member. The lower mounting hanger includes a lower building mount member, and a lower hook portion. The Z-bracket preferably includes a top member, an angled member, and a bottom member. An alignment bar is used to suspend the lower mounting hanger from the building, so the lower mounting hanger may be fastened to the building. The top hanger, the face support bracket and the Z-bracket are assembled to each other and inserted into the gutter member.

17 Claims, 7 Drawing Sheets

LARGE CAPACITY GUTTER

BACKGROUND OF THE INVENTION

1. Field of the Invention

The present invention relates generally to building construction and more specifically to a large capacity gutter, which is able to withstand wind pressures on commercial buildings per the ANSI/SPRI GT-1 gutter standard test.

2. Discussion of the Prior Art

There are numerous gutters in the art. However, it appears that the prior art does not teach or suggest a large capacity gutter, which includes an alignment tool for installing a lower mounting hanger. A proportionately fitted internal bracket eliminates the need for external brackets.

Accordingly, there is a clearly felt need in the art for a large capacity gutter, which can withstand wind pressures on commercial buildings per the ANSI/SPRI GT-1 gutter standard test; and which utilizes an alignment tool for installing a lower mounting hanger for improved installation.

SUMMARY OF THE INVENTION

The present invention provides a large capacity gutter, which utilizes an alignment tool for installing a lower mounting hanger for improved overall installation accuracy and speed. The lower mounting hanger is designed to prevent upward gutter movement due to wind pressures. The large capacity gutter preferably includes a gutter member, a top hanger, a face support bracket, a lower mounting hanger, and a Z-bracket. The gutter member preferably includes a bottom wall, a building wall, a front wall, a front lip and a front hook. The building wall extends upward from a building edge of the bottom wall. The front wall extends upward from a front edge of the bottom wall. The front lip extends inward from a top edge of the front wall. The front lip is terminated by the front hook. A gutter cleat extends from an outside surface of the building wall. The gutter cleat includes a gutter mount portion and a gutter cleat lip, which extends upward at an acute angle from a bottom of the gutter mount portion.

The top hanger preferably includes an upper building mount member, a lengthwise support member and a gutter support projection. The upper building mount member extends upward from one end of the lengthwise support member. The gutter support projection extends upward from an opposing end of the lengthwise support member. The gutter support projection includes a gutter upright portion and a gutter hook portion. The gutter upright extends upward from the opposing end of the lengthwise support member. The gutter hook portion extends inward from an end of the gutter upright portion. The face support bracket preferably includes an L-building mount member, an L-lengthwise support member and an L-vertical member. The L-building mount member extends upward from a building end of the L-lengthwise support member. The L-vertical member extends downward from a front end of the L-lengthwise support member.

The lower mounting hanger includes a lower building mount member, and a lower hook portion. The lower hook portion includes an angled portion and a lower lock lip. The angled portion extends upward from a bottom of the lower building mount member. The lower lock lip terminates an end of the angled portion by extending inward therefrom.

The Z-bracket preferably includes a top member, an angled member, and a bottom member. A lower upright member extends upward from one end of the bottom member. One end of the angled member extends outward from an opposing end of the bottom member. One end of the top member extends inward from an opposing end of the angled member. An opposing end of the top member is terminated with a building mount member.

An alignment bar preferably includes a horizontal support member, a vertical leg and an upright hook member. The vertical leg extends downward from an end of the horizontal support member. The upright hook member extends upward from a bottom of the vertical leg. The large capacity gutter is preferably installed in the following manner. The horizontal support member of at least two alignment bars are placed on a top edge of a building, over a roof membrane and the vertical leg is pushed against a side of a building. The lower hook portion of the lower gutter hanger is hung on the upright hook members of the alignment bars. The alignment bar vertically locates, and holds, the lower mounting hanger relative to a building wall. A plurality of screws are driven through the lower building mount member of the lower mounting hanger and into the building wall. All the lower mounting hangers are first installed before the gutter miter or the gutter members are installed. The lower mounting hanger has a lapped end that interlocks with the next successive length. The alignment bars are now removed from the lower mounting hanger and the building.

A gutter miter preferably includes a first miter member and a second miter member. The first miter member extends from the second miter member at a 90-degree angle. Each miter member includes a bottom miter wall, a building miter wall, a front miter wall, a front miter lip and a front miter hook. The building miter wall extends upward from a building edge of the bottom miter wall. The front miter wall extends upward from a front edge of the bottom miter wall. The front miter lip extends inward from a top edge of the front miter wall. The front miter lip is terminated by the front miter hook. A miter cleat is attached to a bottom outside surface of the building miter wall by means of a specialized rivet that does not puncture the inside wall of the gutter, and therefore, remains sealed and will not permit leakage of any kind. The miter cleat includes a miter mount portion and a miter cleat lip, which extends upward at an acute angle from a bottom of the miter mount portion. The miter cleats of the first and second miter members are pushed into the lower mounting hangers. The gutter cleat of the gutter member is also pushed into lower mounting hangers.

A splice member is used to join an end of the gutter member and the first or second miter member. Each splice member includes a splice bottom wall, a splice building wall, a splice front wall, and a splice front lip. The splice building wall extends upward from a splice building edge of the splice bottom wall. The splice front wall extends upward from a front edge of the splice bottom wall. The splice front lip extends inward from a top edge of the splice front wall. A non-curing sealant is preferably applied to an inside surface of the gutter member and an inside surface of the miter member before insertion of the splice member. The lengthwise support member of the top hanger, the top member of the Z-bracket and the L-lengthwise support member of the face support bracket are attached to each other with at least one fastener to form a gutter support device. The gutter support device is installed into the gutter member by rotating the gutter hook portion of the top hanger into the front lip of the gutter member and pushing thereof into an inner perimeter of the gutter member. A plurality of bracket fasteners are driven through the gutter hook portion of the top bracket and the front lip of the gutter member. A plurality of building mount fasteners are driven through the upper building mount member of the top hanger, the building mount member of the Z-bracket, the L-building mount member of the face support bracket and the roof membrane. An end cap is used to cover an open end of the gutter member. The end cap is attached to an end of the gutter member with rivets and sealed with a non-curing sealant.

Accordingly, it is an object of the present invention to provide a large capacity gutter, which can withstand wind pressures on commercial buildings per the ANSI/SPRI GT-1 gutter standard test.

Finally, it is another object of the present invention to provide a large capacity gutter, which utilizes an alignment tool for installing a lower mounting hanger for improved installation. These and additional objects, advantages, features and benefits of the present invention will become apparent from the following specification.

DETAILED DESCRIPTION OF THE PREFERRED EMBODIMENTS

Figure 1:
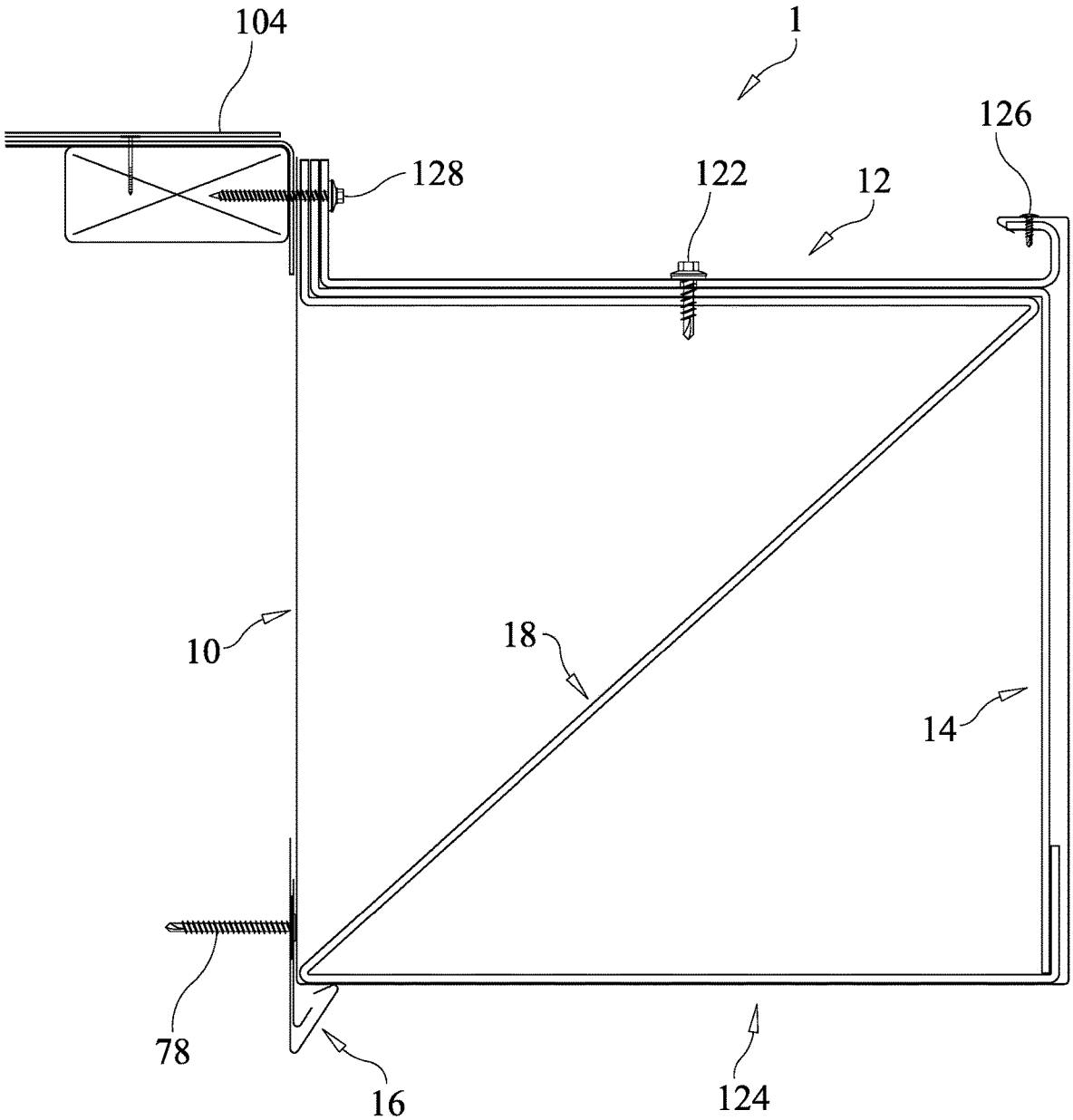
FIG. 1 is a cross sectional view of the large capacity gutter installed on a side wall of a building in accordance with the present invention.
Figure 2:
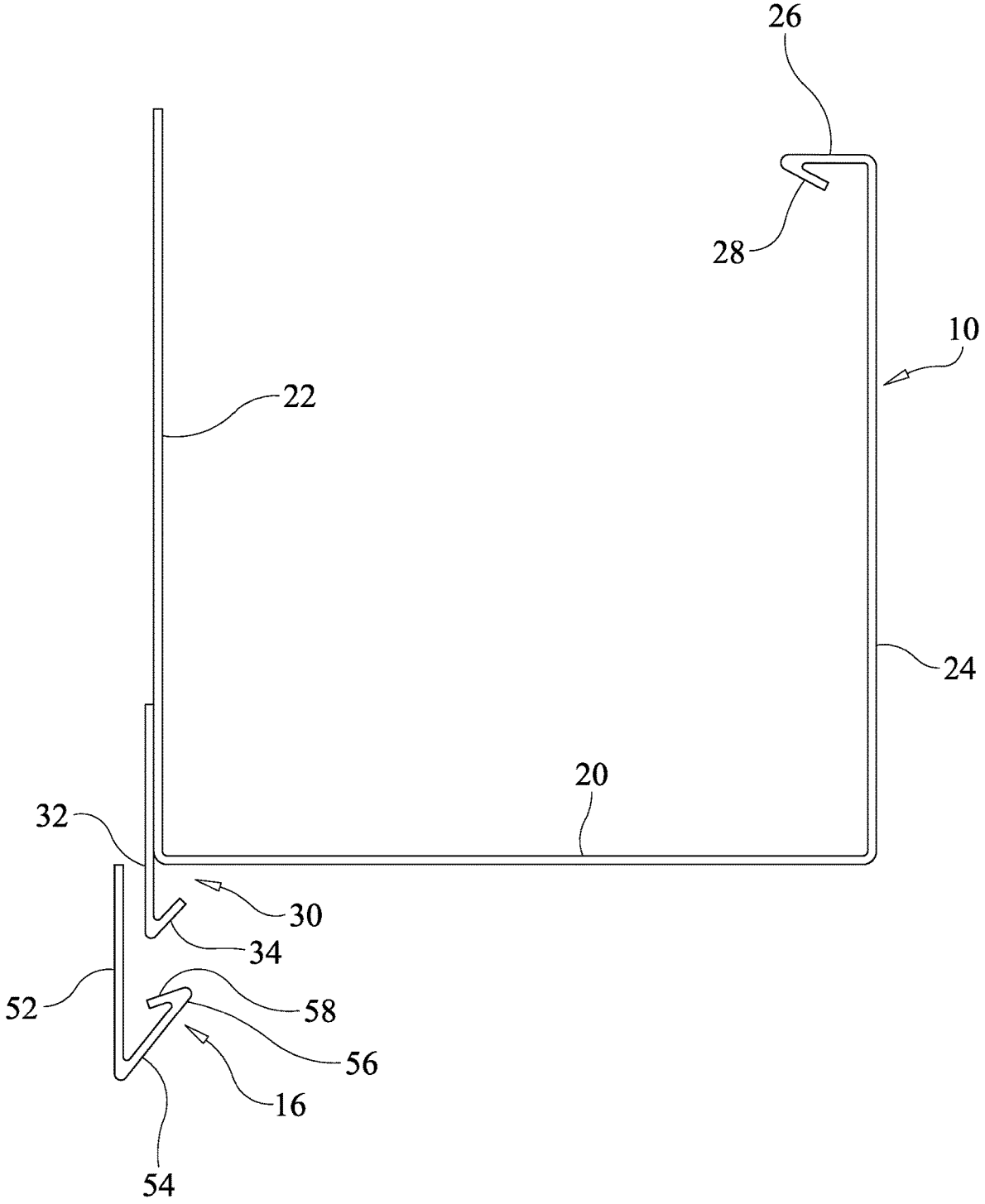
FIG. 2 is a view of a gutter member adjacent a lower mounting hanger, of a large capacity gutter in accordance with the present invention.
Figure 3:
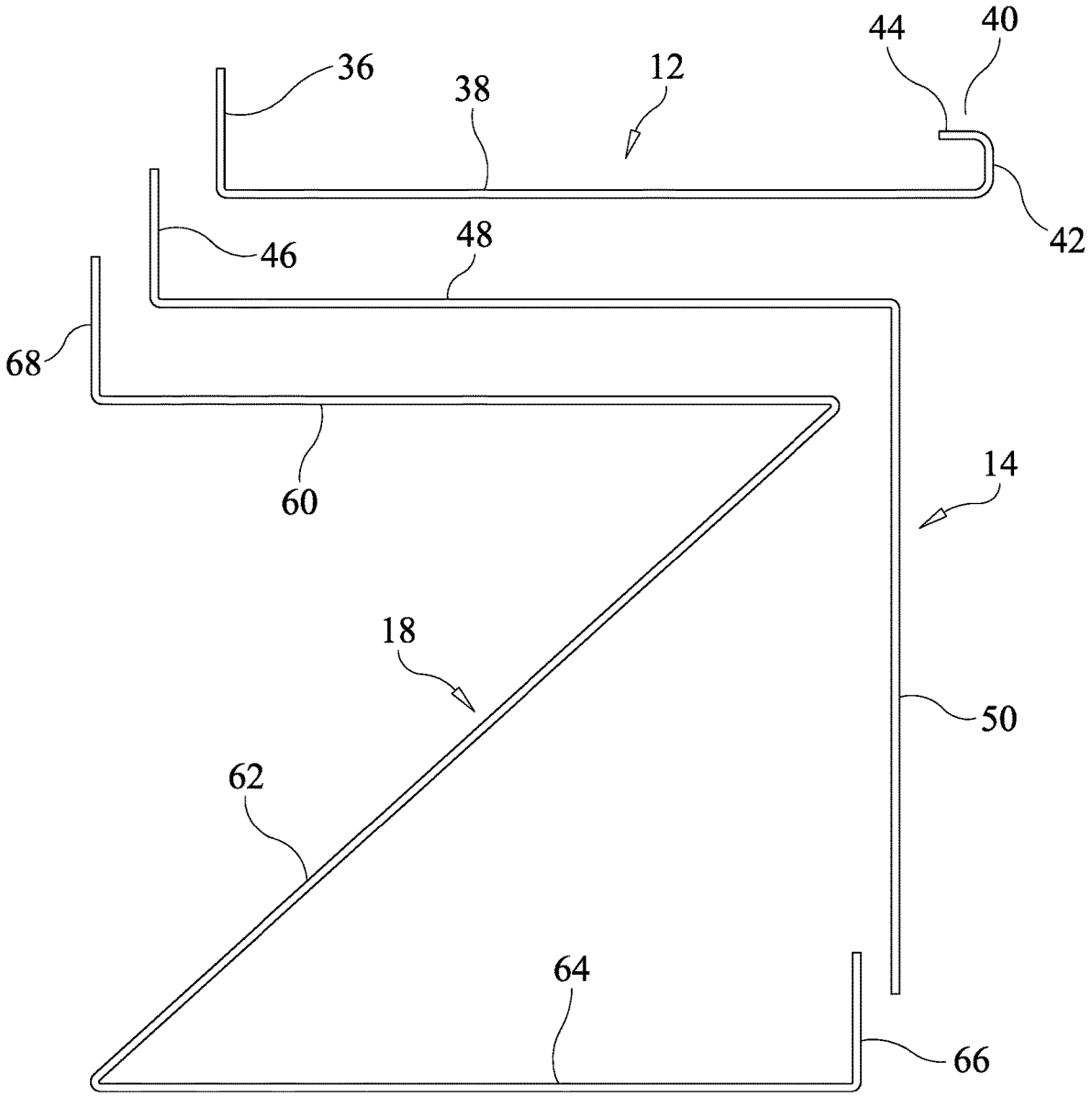
FIG. 3 is an exploded end view of a gutter support device of a large capacity gutter in accordance with the present invention.

With reference now to the drawings, and particularly to FIG. 1, there is shown an end view of a large capacity gutter 1. With reference to FIGS. 2-4 and 9, the large capacity gutter 1 preferably includes a gutter member 10, a top hanger 12, a face support bracket 14, a lower mounting hanger 16, and a Z-bracket 18. The gutter member 10 preferably includes a bottom wall 20, a building wall 22, a front wall 24, a front lip 26 and a front hook 28. The building wall 22 extends upward from a building edge of the bottom wall 20. The front wall 24 extends upward from a front edge of the bottom wall 20. The front lip 26 extends inward from a top edge of the front wall 24. The front lip 26 is terminated by the front hook 28. A gutter cleat 30 extends from an outside surface of the building wall 22. The gutter cleat 30 includes a gutter mount portion 32, and a gutter cleat lip 34, which extends upward at an acute angle from a bottom of the gutter mount portion 32.

The top hanger 12 preferably includes an upper building mount member 36, a lengthwise support member 38 and a gutter support projection 40. The upper building mount member 36 extends upward from one end of the lengthwise support member 38. The gutter support projection 40 extends upward from an opposing end of the lengthwise support member 38. The gutter support projection 40 includes a gutter upright portion 42 and a gutter hook portion 44. The gutter upright portion 42 extends upward from the opposing end of the lengthwise support member 38. The gutter hook portion 44 extends inward from a top of the gutter upright portion 42. The face support bracket 14 preferably includes an L-building mount member 46, an L-lengthwise support member 48 and an L-vertical member 50. The L-building mount member 46 extends upward from a building end of the L-lengthwise support member 48. The L-vertical member 50 extends downward from a front end of the L-lengthwise support member 48.

The lower mounting hanger 16 includes a lower building mount member 52 and a lower hook portion 54. The lower hook portion 54 includes an angled portion 56 and a lower lock lip 58. The angled portion 56 extends upward from a bottom of the lower building mount member 52 at an acute angle. The lower lock lip 58 terminates an end of the angled portion 56 by extending inward therefrom. The Z-bracket 18 preferably includes a top member 60, an angled member 62 and a bottom member 64. A lower upright member 66 extends upward from one end of the bottom member 64. One end of the angled member 62 extends outward from an opposing end of the bottom member 64. One end of the top member 60 extends inward from an opposing end of the angled member 62. An opposing end of the top member 60 is terminated with a building mount member 68.

Figure 4:
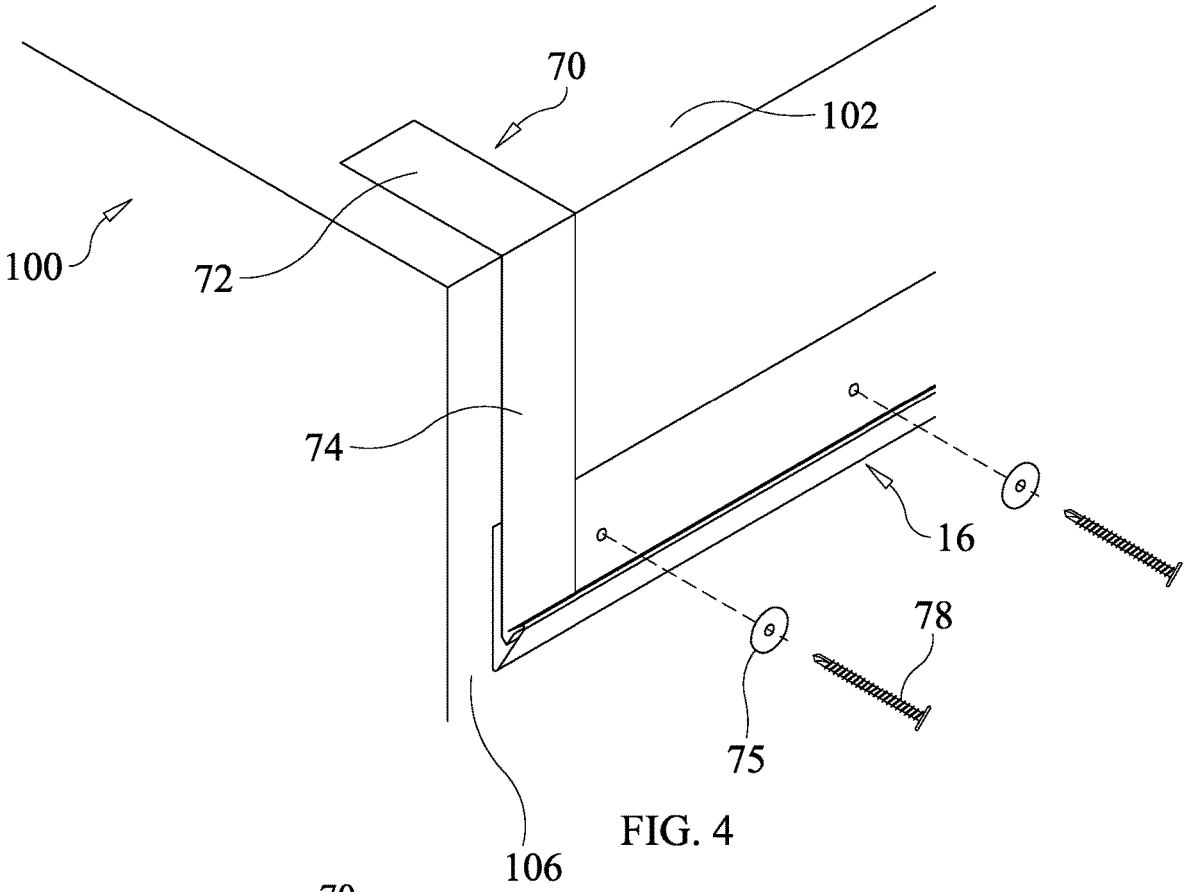
FIG. 4 is a perspective view of an alignment bar resting on top of an edge of a building and a lower mounting hanger, suspended from the alignment bar of a large capacity gutter in accordance with the present invention.
Figure 5:
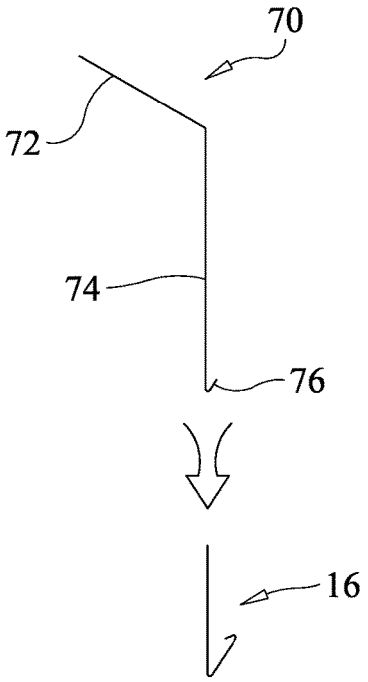
FIG. 5 is an exploded end view of an alignment bar adjacent a lower mounting hanger, before insertion of the alignment bar into the lower mounting hanger of a large capacity gutter in accordance with the present invention.
Figure 6:
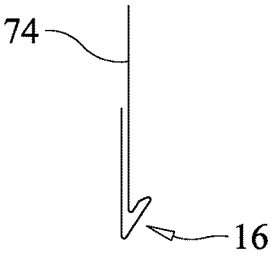
FIG. 6 is an end view of an alignment bar inserted into a lower mounting hanger, of a large capacity gutter in accordance with the present invention.

With reference to FIGS. 4-6, a bar (alignment bar) 70 preferably includes a horizontal support member 72, a vertical leg 74 and an upright hook member 76. The vertical leg 74 extends downward from an end of the horizontal support member 72. The upright hook 76 member extends upward from a bottom of the vertical leg 74. The large capacity gutter 1 is preferably installed in the following manner. The horizontal support member 72 of at least two alignment bars 70 are placed on a top edge 102 of a building 100, over a roof membrane 104 and the vertical leg 74 is pushed against a side wall 106 of the building 100. The lower hook portion 54 of the lower mounting hanger 16 is hung on the upright hook members 76 of the alignment bars 70. The alignment bars 70 vertically locate the lower mounting hanger 16 relative to the building wall 106. A plurality of fasteners 78 are driven through the lower building mount member 74 of the lower mounting hanger 16 and into the building wall 106 with a plurality of washers 75. All the lower mounting hangers 16 are first installed, before a gutter miter 80 or the gutter members 10 are installed. The bars 70 are now removed from the lower mounting hanger 16 and the building 100.

Figure 7:
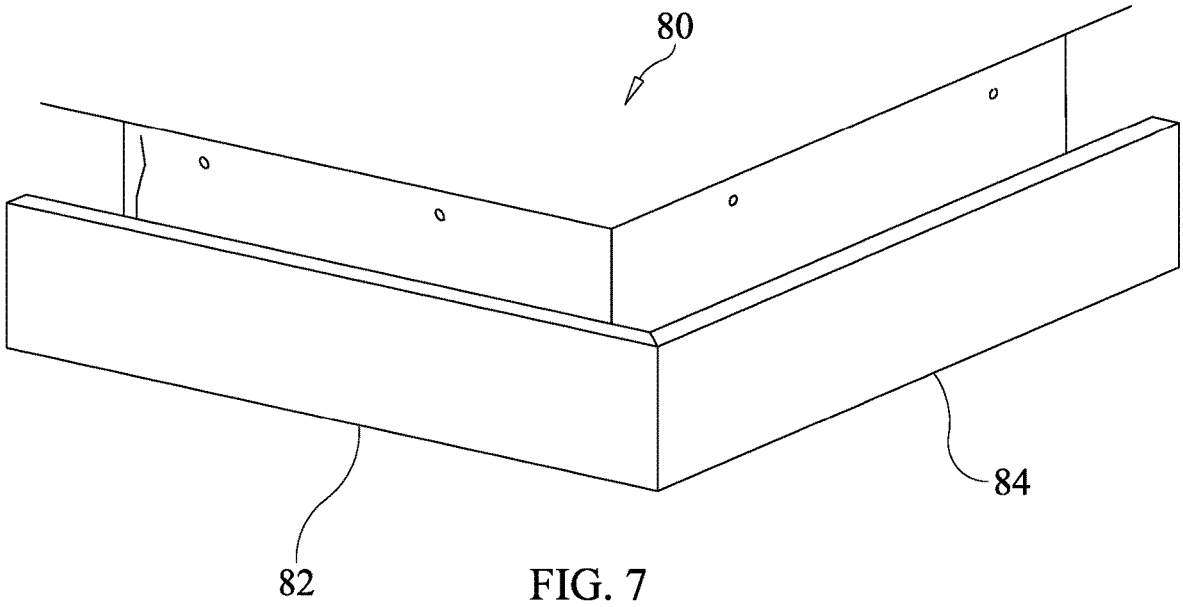
FIG. 7 is a perspective view of a gutter miter of a large capacity gutter in accordance with the present invention.
Figure 8:
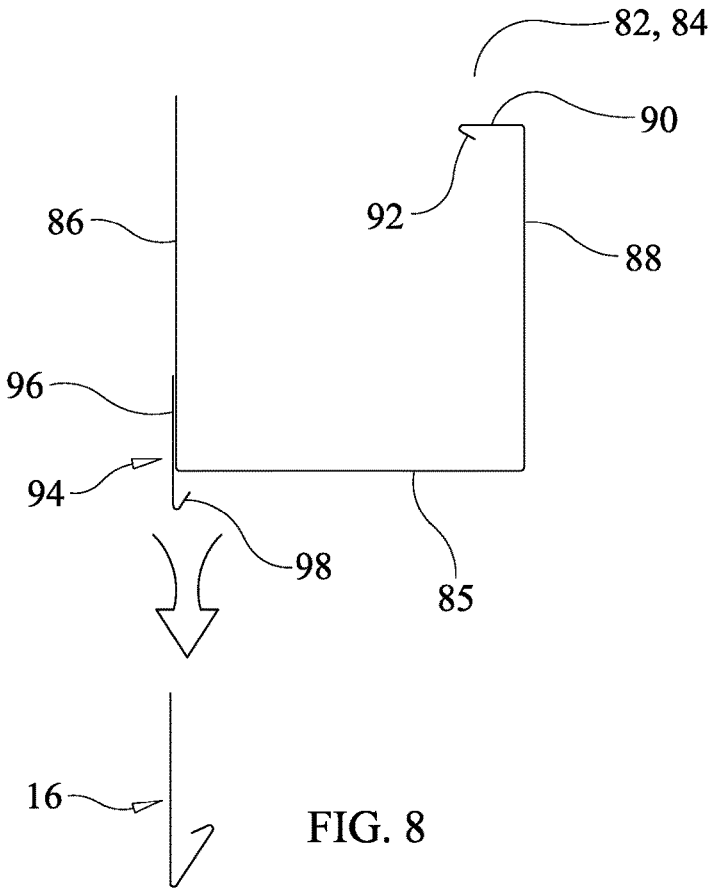
FIG. 8 is an exploded end view of a portion of a gutter miter adjacent a lower mounting hanger, of a large capacity gutter in accordance with the present invention.
Figure 9:
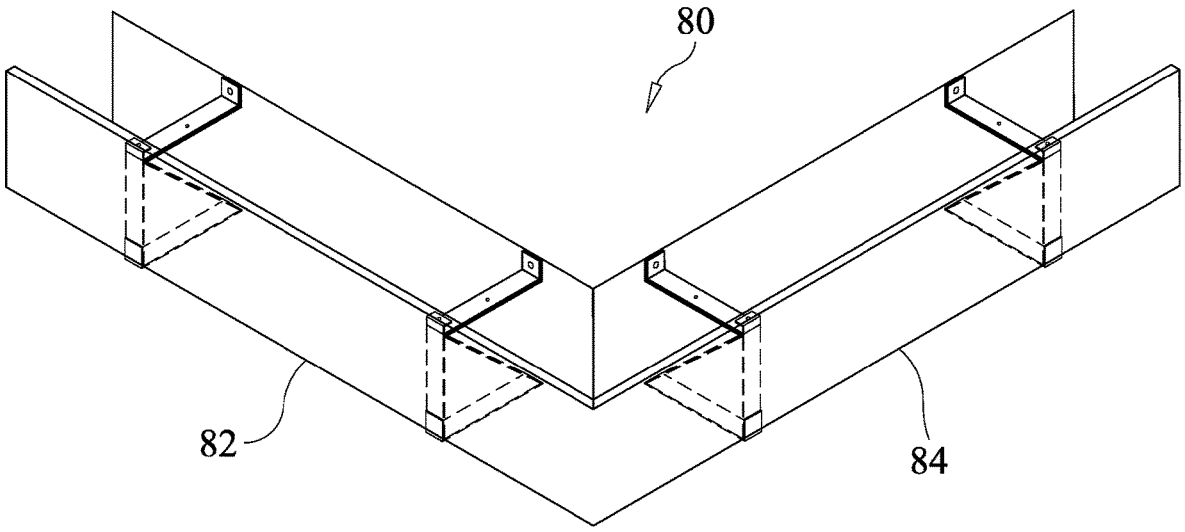
FIG. 9 is a perspective view of a gutter miter of a large capacity gutter in accordance with the present invention.

With reference to FIGS. 7-9, the gutter miter 80 preferably includes a first miter member 82 and a second miter member 84. The first miter member 82 extends from the second miter member 84 at a 90-degree angle. Each miter member 82, 84 preferably includes a bottom miter wall 85, a building miter wall 86, a front miter wall 88, a front miter lip 90 and a front miter hook 92. The building miter wall 86 extends upward from a building edge of the bottom miter wall 85. The front miter wall 88 extends upward from a front edge of the bottom miter wall 85. The front miter lip 90 extends inward from a top edge of the front miter wall 88. The front miter lip 90 is terminated by the front miter hook 92. A miter cleat 94 is attached to a bottom and outside surface of the building miter wall 86. The miter cleat 94 includes a miter mount portion 96, and a miter cleat lip 98, which extends upward at an acute angle from a bottom of the miter mount portion 96. The miter cleats 96 of the first and second miter members are pushed into the lower mounting hangers 16. The gutter cleat 30 of the gutter member 10 is also pushed into lower mounting hangers 16.

Figure 10:
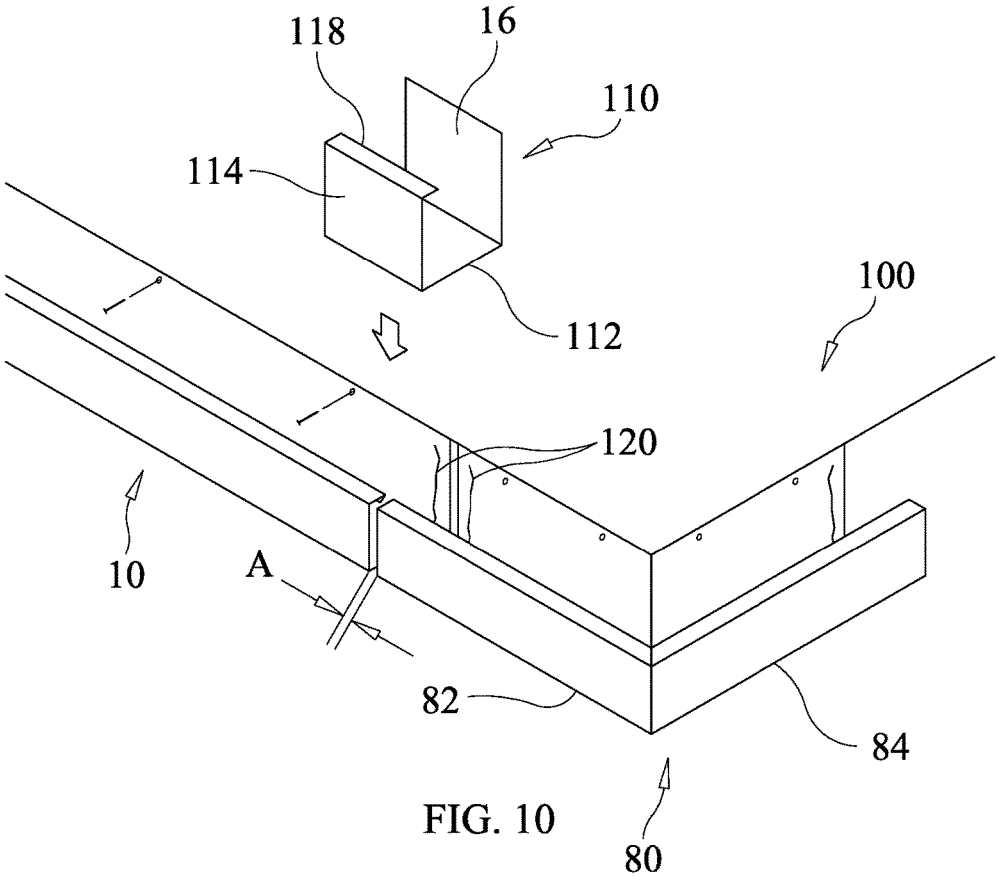
FIG. 10 is an exploded perspective view of a splice adjacent a gutter miter and a gutter miter of a large capacity gutter, before joining the gutter miter to the gutter member with the splice in accordance with the present invention.
Figure 11:
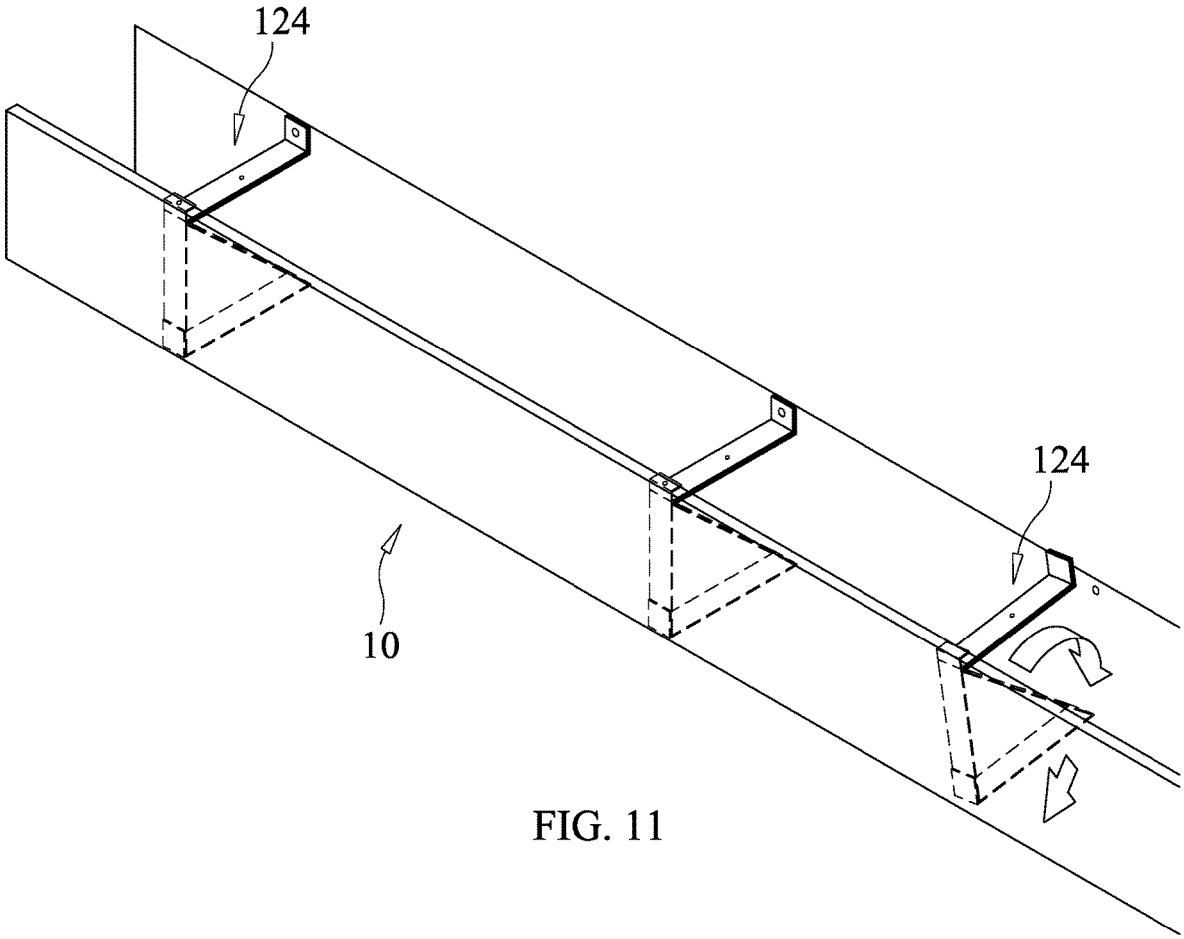
FIG. 11 is a perspective view of a gutter support device being rotated into a gutter member in accordance with the present invention.

With reference to FIGS. 10-11, a splice member 110 is used to join an end of the gutter member 10 and the first or second miter member 82, 84. Each splice member 110 includes a splice bottom wall 112, a splice building wall 114, a splice front wall 116 and a splice front lip 118. The splice building wall 116 extends upward from a splice building edge of the splice bottom wall 112. The splice front wall 114 extends upward from a front edge of the splice bottom wall 112. The splice front lip 118 extends inward from a top edge of the front wall 114. A non-curing sealant 120 is preferably applied to an inside surface of the gutter member 10 and an inside surface of the miter member 82, before insertion of the splice member 110. It is preferable to leave a gap "A" between the gutter member 10 and the first miter member 82. The following dimension "A" is given by way of example and not by way of limitation. Satisfactory results have been found when dimension "A" has a value of ⅜ inch.

The lengthwise support member 38 of the top hanger 12, the top member 60 of the Z-bracket 18 and the L-lengthwise support member 48 of the face support bracket 14 are attached to each other with at least one fastener 122 to form a gutter support device 124. The gutter support device 124 is installed into the gutter member 10 (or the gutter miter 80) by rotating the gutter hook portion 44 into the front lip 26 of the gutter member 10 and pushing the gutter support device 124 into an inner perimeter of the gutter member 10 (or the gutter miter 80). A plurality of bracket fasteners 126 are driven through the gutter hook portion 44 and the front lip 26 of the gutter member 10. A plurality of building mount fasteners 128 are driven through the upper building mount member 36 of the top hanger 12, the L-building mount member 46 of the face support bracket 14, the building mount member 68 of the Z-bracket 18 and the roof membrane 104. An end cap (not shown) is used to cover an open end of the gutter member 10. The end cap is preferably attached to an end of the gutter member 10 with rivets and sealed with a non-curing sealant.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A large capacity gutter for attachment to a building, comprising:

a gutter member includes a bottom wall, a front wall and a building wall, said front wall extends upward from one edge of said bottom wall, said building wall extends upward from an opposing edge of said bottom wall;

a top hanger includes an upper building mount member one end and a gutter support projection on an opposing end, said gutter support projection is engaged with a top of said front wall;

a face support bracket includes a L-building mount member, a L-lengthwise support member and a L-vertical member, said L-building mount member extends upward from one end of said L-lengthwise support member, said L-vertical member extends downward from an opposing end of said L-lengthwise support member, said L-vertical contacts said front wall and extends to said bottom wall, said face support bracket is retained inside said gutter member, wherein said upper building mount member and said L-building mount member are attached to the building; and a lower mounting hanger includes a lower building mount member and a lower hook portion, said lower hook portion extends upward from a bottom of said lower building mount member, wherein said lower building mount member is attached to the building.

2. The large capacity gutter of claim 1, wherein:

at least one fastener is used to secure said upper building mount member and said L-building mount member to the building.

3. The large capacity gutter of claim 2, wherein:

a top of said front wall of said gutter member is terminated with a front lip, said front lip is structured to receive said gutter support projection.

4. The large capacity gutter of claim 1, further comprising:

a gutter cleat is attached to a bottom of said building wall, said gutter cleat includes a gutter mount portion and a gutter cleat lip which extends upward from a bottom of said gutter mount portion, wherein said lower hook portion is sized to receive said gutter cleat lip.

5. A large capacity gutter for attachment to a building, comprising:

a gutter member includes a bottom wall, a front wall and a building wall, said front wall extends upward from one edge of said bottom wall, said building wall extends upward from an opposing edge of said bottom wall;

a top hanger includes an upper building mount member one end and a gutter support projection on an opposing end, said gutter support projection is engaged with a top of said front wall; and a Z-bracket includes an angled member, top member, and a building mount member, said building mount member extends upward from one end end of said top member, said angled member extends downward and inward from an opposing end of said top member at an acute angle relative to said top member, a bottom of said angled member contacts said bottom wall, said angled member extends from said front wall to said building wall, said angled member is located inside said gutter member, wherein said upper building mount member and said building mount member are attached to the building.

6. The large capacity gutter of claim 5, wherein:

at least one fastener is used to secure said upper building mount member and said L-building mount member to the building.

7. The large capacity gutter of claim 6, wherein:

a top of said front wall of said gutter member is terminated with a front lip, said front lip is structured to receive said gutter support projection.

8. The large capacity gutter of claim 6, wherein:

a bottom member extends from a bottom of said angled member.

9. The large capacity gutter of claim 5, wherein:

a lower mounting hanger includes a lower building mount member and a lower hook portion, said lower hook portion extends upward from a bottom of said lower building mount, wherein said lower building mount member is attached to the building.

10. The large capacity gutter of claim 9, wherein:

an alignment bar for setting a height of said lower mounting hanger relative to a top edge of the building, said lower mounting hanger is attached to a wall of the building.

11. The large capacity gutter of claim 10, further comprising:

said alignment bar includes a horizontal support member, a vertical leg and an upright hook member, said vertical leg extends downward from an end of said horizontal support member, said upright hook member extends upward from a bottom of said vertical leg, said upright hook member is sized to be received by said lower hook portion.

12. The large capacity gutter of claim 9, further comprising:

a gutter cleat is attached to a bottom of said building wall, said gutter cleat includes a gutter mount portion and a gutter cleat lip which extends upward from a bottom of said gutter mount portion, wherein said lower hook portion is sized to receive said gutter cleat lip.

13. A large capacity gutter for attachment to a building structure, comprising:

a gutter member includes a bottom wall, a front wall, a building wall and a front lip, said front wall extends upward from one edge of said bottom wall, said building wall extends upward from an opposing edge of said bottom wall, said front lip extends inward from a top of said front wall;

a gutter support device includes a building mount member, a top member, a L-vertical member, a bottom member, and a gutter support projection, said building mount member extends upward from one end of said top member, said L-vertical member extends downward from an opposing end of said top member, one end of said bottom member is located adjacent a bottom of said L-vertical member, said bottom member contacts at least most of said bottom wall, said gutter support projection extends upward from an opposing end of said top member, said gutter support projection supports said front lip, an inside of said gutter member is sized to receive an outer perimeter of said gutter support device, and, wherein said building mount member is attached directly to a wall of the building structure.

14. The large capacity gutter of claim 13, wherein:

said gutter support device includes a top hanger, a Z-bracket and a face support bracket, at least one fastener is used to secure said top hanger, Z-bracket and face support bracket to each other.

15. The large capacity gutter of claim 13, further comprising:

a lower mounting hanger, is shaped to receive a bottom of said gutter member, wherein said lower mounting hanger is attached to a wall of the building structure, said building mount member is attached to the wall of the building structure.

16. The large capacity gutter of claim 15, wherein:

said lower mounting hanger includes a lower building mount member and a lower hook portion, said lower hook portion extends upward from a bottom of said lower building mount member.

17. The large capacity gutter of claim 16, further comprising:

a gutter cleat is attached to a bottom of said building wall of said gutter member, said gutter cleat includes a gutter mount portion and a gutter cleat lip which extends upward from a bottom of said gutter mount portion, wherein said lower hook portion is sized to receive said gutter cleat lip.

* * * * *